US008049675B2

(12) United States Patent
Kozuma et al.

(10) Patent No.: US 8,049,675 B2
(45) Date of Patent: Nov. 1, 2011

(54) MULTI-FEED HORN, LOW NOISE BLOCK DOWNCONVERTER PROVIDED WITH THE SAME AND ANTENNA APPARATUS

(75) Inventors: Yuji Kozuma, Habikino (JP); Hitoshi Tanaka, Neyagawa (JP)

(73) Assignee: Sharp Kabushiki Kaisha, Osaka (JP)

( * ) Notice: Subject to any disclaimer, the term of this patent is extended or adjusted under 35 U.S.C. 154(b) by 398 days.

(21) Appl. No.: 12/411,010

(22) Filed: Mar. 25, 2009

(65) Prior Publication Data

US 2009/0267853 A1 Oct. 29, 2009

(30) Foreign Application Priority Data

Apr. 23, 2008 (JP) ..... 2008-112750

(51) Int. Cl.
*H01Q 13/02* (2006.01)

(52) U.S. Cl. ..... 343/786; 343/705; 343/772; 343/776

(58) Field of Classification Search ..... 343/705, 343/772, 776, 779, 786
See application file for complete search history.

(56) References Cited

U.S. PATENT DOCUMENTS 2,751,586 A * 6/1956 Riblet ..... 342/153
5,113,197 A * 5/1992 Luh ..... 343/776
6,621,375 B2 * 9/2003 Vezmar et al. ..... 333/125
7,102,585 B2 * 9/2006 Hsiu et al. ..... 343/786
7,224,320 B2 * 5/2007 Cook ..... 343/772
7,239,285 B2 * 7/2007 Cook ..... 343/786

FOREIGN PATENT DOCUMENTS

JP 58-197901 A 11/1983
JP 63-114402 A 5/1988
JP 63-125408 U 8/1988
JP 5-218735 A 8/1993
JP 2001-244724 A 9/2001
JP 2005-286713 A 10/2005
JP 2006-211116 A 8/2006
JP 2006-324964 A 11/2006
JP 2007-104461 A 4/2007

* cited by examiner

*Primary Examiner* — Douglas W Owens
*Assistant Examiner* — Chuc D Tran
(74) *Attorney, Agent, or Firm* — Birch, Stewart, Kolasch & Birch, LLP

(57) ABSTRACT

A multi-feed horn includes a first feed horn, a second feed horn and a third feed horn which are connected to a first waveguide, a second waveguide and a third waveguide, respectively. The first feed horn is provided with a first proximal end opening and a first tip opening which are rectangular in shape, the second feed horn is provided with a second proximal end opening and a second tip opening which are rectangular in shape, and the third feed horn is provided with a third proximal end opening and a third tip opening which are rectangular in shape. Consequently, a multi-feed horn, a low noise block downconverter and an antenna apparatus which allow a further improvement in the reception characteristic and in the manufacturing accuracy can be provided.

8 Claims, 5 Drawing Sheets

MULTI-FEED HORN, LOW NOISE BLOCK DOWNCONVERTER PROVIDED WITH THE SAME AND ANTENNA APPARATUS

This nonprovisional application is based on Japanese Patent Application No. 2008-112750 filed on Apr. 23, 2008 with the Japan Patent Office, the entire contents of which are hereby incorporated by reference.

BACKGROUND OF THE INVENTION

1. Field of the Invention

The present invention relates to a multi-feed horn, a low noise block downconverter provided with the same and an antenna apparatus, and particularly to a multi-feed horn used for receiving communication with a plurality of satellites, a low noise block downconverter provided with the same and an antenna apparatus.

2. Description of the Background Art

The communication using an artificial satellite is assigned with a frequency band depending on the intended use. Mainly, the satellite for satellite television broadcasting or the like is assigned with a Ku band (frequency band: 12-18 GHz) and the communication satellite is assigned with a Ka band (frequency band: 26-46 GHz). The broadcasting satellite and the communication satellite are in geostationary orbit around the Earth. In recent years, a plurality of communication satellites which are located close to each other are in geostationary orbit. An antenna provided with a multi-feed horn is used to receive the radio waves from these plurality of communication satellites and the like.

With regard to a multi-feed horn of such an antenna, the multi-feed horn disclosed in Japanese Patent Laying-Open No. 2006-324964 will be hereinafter described. As shown in FIGS. 9 and 10, in a multi-feed horn 101, in order to receive the radio wave from each of three communication satellites, three feed horns 111, 121 and 131 are disposed such that their respective central axes (not shown) are arranged parallel to each other. Feed horns 111, 121 and 131 are provided with proximal end openings 112, 122 and 132, and tip openings 113, 123 and 133, respectively. The conventional multi-feed horn 101 is configured as described above.

SUMMARY OF THE INVENTION

In multi-feed horn 101 described above, feed horns 111, 121 and 131 have proximal end openings 112, 122 and 132 and tip openings 113, 123 and 133, respectively, which are circular in shape.

The invention of the present application aims to ensure a wider reception frequency band and to improve the dimensional accuracy as compared to the conventional multi-feed horn. One of its objects is to provide a multi-feed horn which allows a further improvement in the reception characteristic and in the manufacturing accuracy. Another object is to provide a low noise block downconverter provided with such a multi-feed horn, and still another object is to provide an antenna apparatus.

The multi-feed horn according to the present invention includes a first feed horn, a second feed horn and a third feed horn. The first feed horn has a first proximal end opening connected to a predetermined first waveguide and a first tip opening which is opened and located on the side opposite to the first proximal end opening. The second feed horn has a second proximal end opening connected to a predetermined second waveguide disposed adjacent to the first waveguide and a second tip opening which is opened and located on the side opposite to the second proximal end opening. The third feed horn has a third proximal end opening connected to a predetermined third waveguide disposed adjacent to the first waveguide on the side opposite to the second waveguide with respect to the first waveguide and a third tip opening which is opened and located on the side opposite to the third proximal end opening. At least the first tip opening of the first feed horn is rectangular in shape.

According to this multi-feed horn, at least the first tip opening of the first feed horn is rectangular in shape, which allows a wider frequency band that can be received to be achieved as compared to the multi-feed horn which is circular in shape. Furthermore, when the sheet metal is subjected to the bending process and the like or the molding process by aluminum die-casting is performed, the bending accuracy and molding accuracy can be ensured to thereby allow the dimensional accuracy of the multi-feed horn to be improved.

More specifically, the multi-feed horn is provided in which the first proximal end opening of the first feed horn is rectangular in shape, the second proximal end opening and the second tip opening of the second feed horn are rectangular in shape, and the third proximal end opening and the third tip opening of the third feed horn are rectangular in shape.

Furthermore, the multi-feed horn may be provided in which the first proximal end opening of the first feed horn is circular in shape, the second proximal end opening and the second tip opening of the second feed horn are rectangular in shape, and the third proximal end opening and the third tip opening of the third feed horn are rectangular in shape.

Furthermore, the multi-feed horn may be provided in which the first proximal end opening of the first feed horn is rectangular in shape, the second proximal end opening and the second tip opening of the second feed horn are circular in shape, and the third proximal end opening and the third tip opening of the third feed horn are circular in shape.

In order to ensure the dimensional accuracy of the multi-feed horn, it is preferable that the first feed horn, the second feed horn and the third feed horn each are formed of a piece of sheet metal or are integrally molded by aluminum die-casting.

The low noise block downconverter according to the present invention includes the multi-feed horn described above, and the antenna apparatus according to the present invention includes the low noise block downconverter.

The low noise block downconverter and the antenna apparatus as described above allow a wider frequency band that can be received to be achieved.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
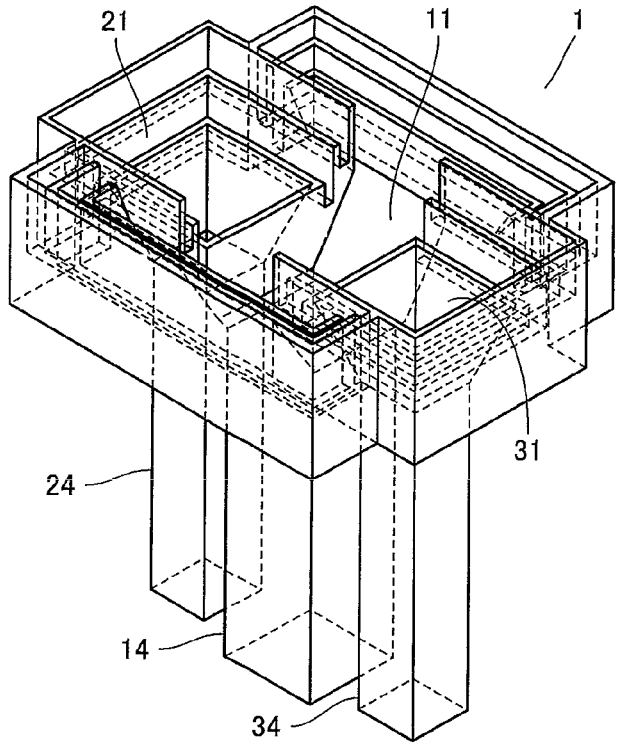
FIG. 1 is a first partial perspective view showing a multi-feed horn according to a first embodiment of the present invention.
Figure 2:
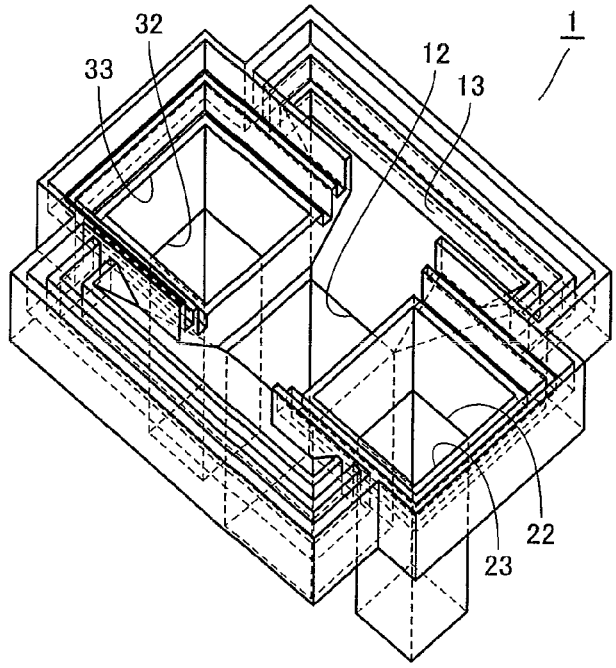
FIG. 2 is a second partial perspective view showing the multi-feed horn in the present embodiment.
Figure 3:
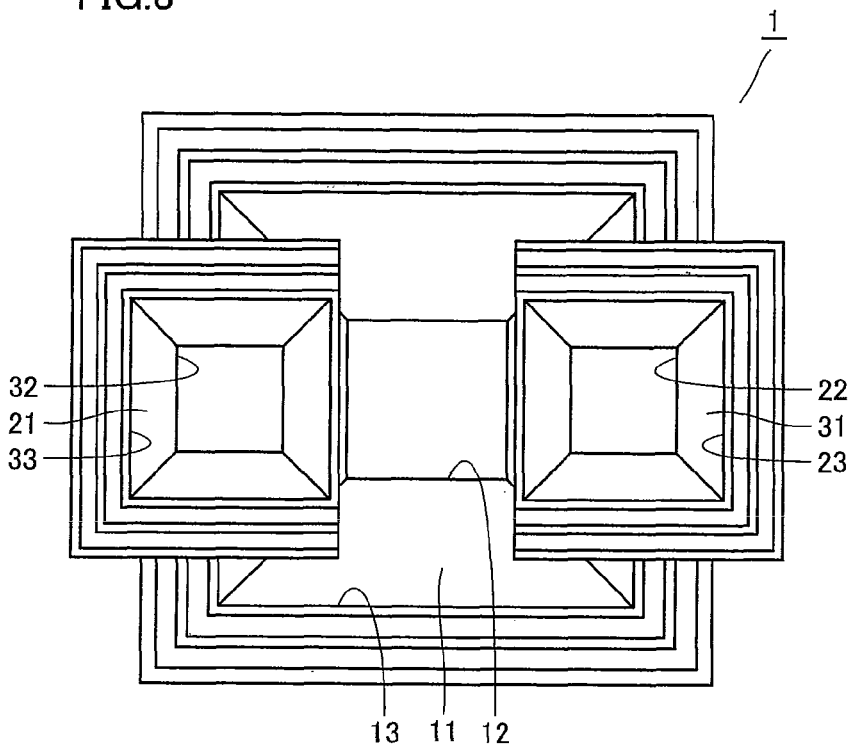
FIG. 3 is a plan view of the multi-feed horn in the present embodiment.

A multi-feed horn will be hereinafter described as a first embodiment of the present invention. As shown in FIGS. 1, 2 and 3, a multi-feed horn 1 includes a first feed horn 11, a second feed horn 21 and a third feed horn 31. First feed horn 11 is used for receiving the radio wave in the Ku band, and second feed horn 21 and third feed horn 31 are used for receiving the radio wave in the Ka band. These first to third feed horns 11 to 31 are formed by subjecting the sheet metal to the bending process and the like or formed by the molding process by aluminum die-casting.

The structure of each of first to third feed horns 11 to 31 will then be described in greater detail. First feed horn 11, second feed horn 21 and third feed horn 31 are connected to a first waveguide 14, a second waveguide 24 and a third waveguide 34, respectively. Second waveguide 24 is disposed adjacent to first waveguide 14. Third waveguide 34 is disposed adjacent to first waveguide 14 on the side opposite to second waveguide 24 with respect to first waveguide 14.

First feed horn 11 is provided with a first proximal end opening 12 connected to first waveguide 14 and a first tip opening 13 which is opened and located on the side opposite to first proximal end opening 12. Furthermore, second feed horn 21 is provided with a second proximal end opening 22 connected to second waveguide 24 and a second tip opening 23 which is opened and located on the side opposite to second proximal end opening 22. Third feed horn 31 is provided with a third proximal end opening 32 connected to third waveguide 34 and a third tip opening 33 which is opened and located on the side opposite to third proximal end opening 32.

In this multi-feed horn 1, first proximal end opening 12, second proximal end opening 22 and third proximal end opening 32 are rectangular in shape, and first tip opening 13, second tip opening 23 and third tip opening 33 are also rectangular in shape. The present multi-feed horn 1 is configured as described above.

In multi-feed horn 1 described above, first to third feed horns 11 to 31 have their respective proximal end openings (first proximal end opening 12, second proximal end opening 22, third proximal end opening 32) which are rectangular in shape, and have their respective tip openings (first tip opening 13, second tip opening 23, third tip opening 33) which are also rectangular in shape.

Consequently, the analytical results obtained by the simulation show that a wider frequency band which can be received can be achieved as compared to the multi-feed horn in which the proximal end openings of the first to third feed horns are circular in shape and the tip openings thereof are also circular in shape.

Furthermore, as the proximal end opening and the tip opening of each of the first to third feed horns of multi-feed horn 1 are rectangular in shape, when the sheet metal is subjected to the bending process and the like or the molding process by aluminum die-casting is performed, the bending accuracy and the molding accuracy can be ensured, and thus, the dimensional accuracy of multi-feed horn 1 to be formed can be improved.

Modification

Figure 4:
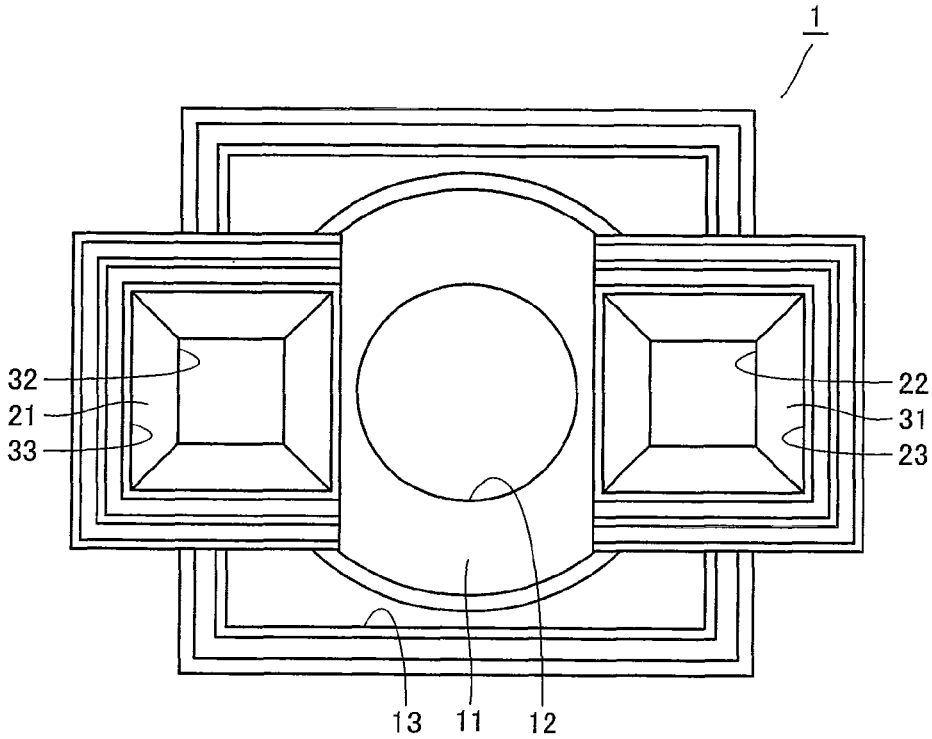
FIG. 4 is a plan view of the multi-feed horn according to a first modification in the present embodiment.

With regard to multi-feed horn 1 as described above, an example has been described in which the first to third feed horns each have the proximal end opening and the tip opening that are rectangular in shape. The multi-feed horn is not limited thereto and, as shown in FIG. 4, for example, only proximal end opening 12 of first feed horn 11 may be circular in shape.

Figure 5:
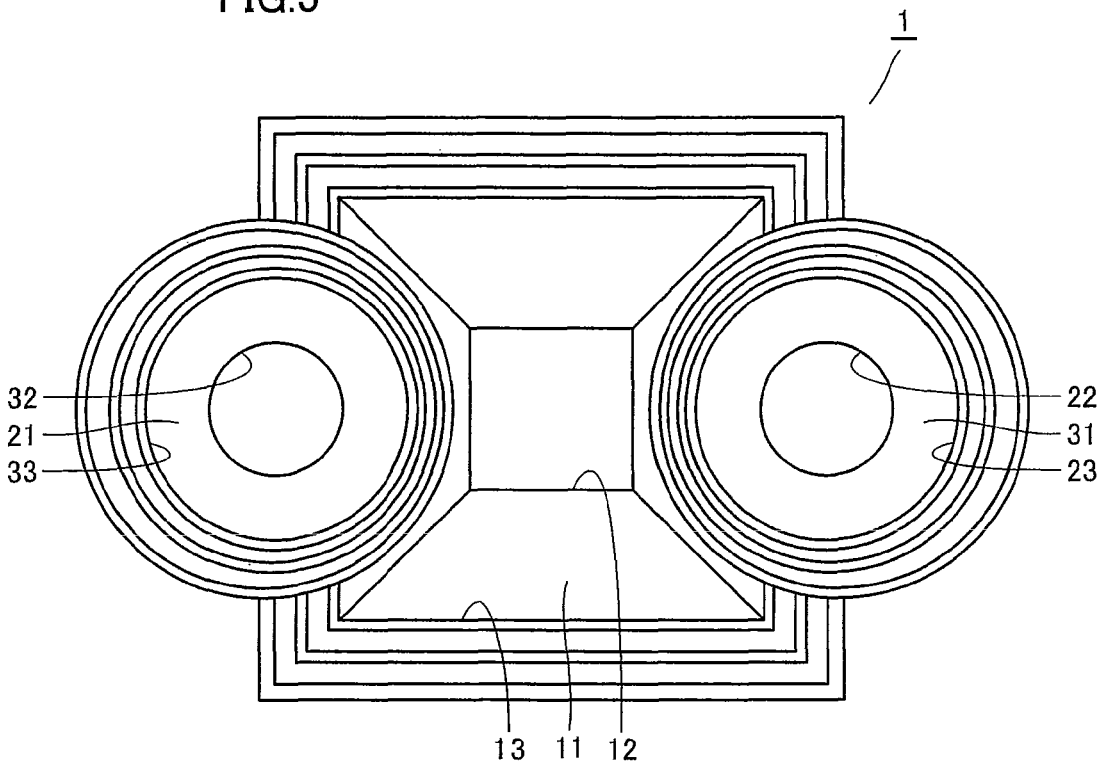
FIG. 5 is a plan view of a multi-feed horn according to a second modification in the present embodiment.

Furthermore, as shown in FIG. 5, multi-feed horn 1 may be provide in which first proximal end opening 12 and first tip opening 13 of first feed horn 11 are rectangular in shape, and the proximal end opening (second proximal end opening 22, third proximal end opening 32) and the tip opening (second tip opening 23, third tip opening 33) of each of second feed horn 21 and third feed horn 31 are circular in shape.

It has been found that, in the case where multi-feed horn 1 as described above is provided with the proximal end opening or the tip opening which is rectangular in shape, a wider frequency band which can be received can be achieved, as compared to the multi-feed horn in which the proximal end opening and the tip opening of each of the first to third feed horns are circular in shape.

Second Embodiment

A low noise block downconverter (LNB) provided with the multi-feed horn described above and an antenna apparatus provided with the low noise block downconverter will be hereinafter described.

Figure 6:
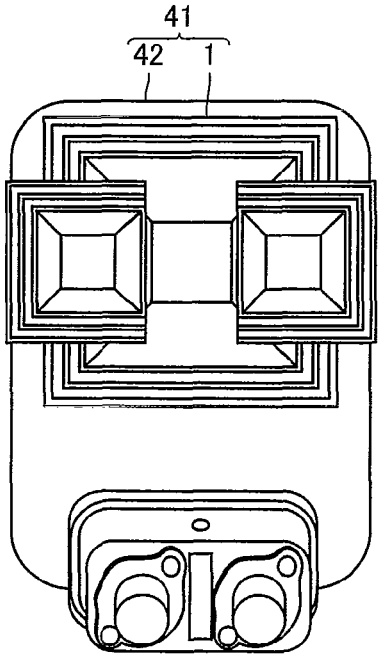
FIG. 6 is a plan view showing a low noise block downconverter provided with a multi-feed horn according to a second embodiment of the present invention.
Figure 7:
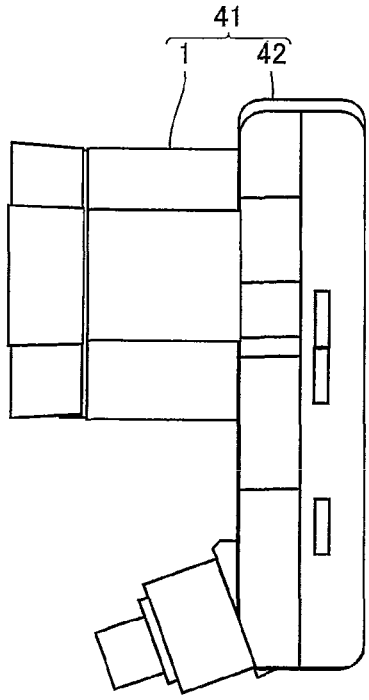
FIG. 7 is a side view showing the low noise block downconverter in the present embodiment.

The low noise block downconverter corresponds to a low noise downconverter, which has the function of converting the received radio wave into a lower frequency to send the same to a receiving circuit because the radio wave in the Ka band or the Ku band is extremely susceptible to attenuation. As shown in FIGS. 6 and 7, a low noise block downconverter 41 is configured to include multi-feed horn 1 described above and a converter body 42.

Figure 8:
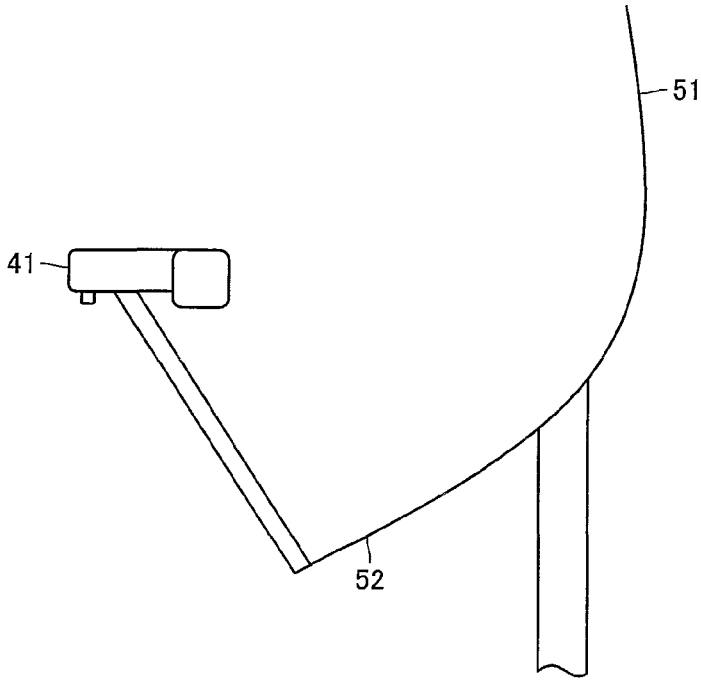
FIG. 8 is a side view showing an antenna apparatus provided with the low noise block downconverter in the present embodiment.
Figure 9:
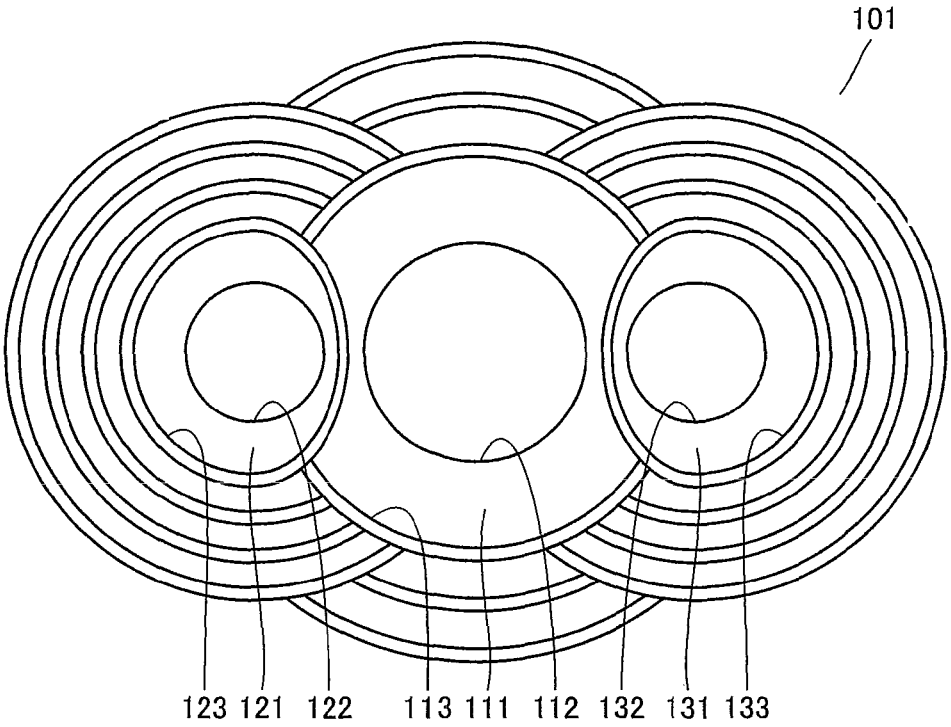
FIG.9 PRIOR ART
FIG. 9 is a plan view showing a conventional multi-feed horn.
Figure 10:
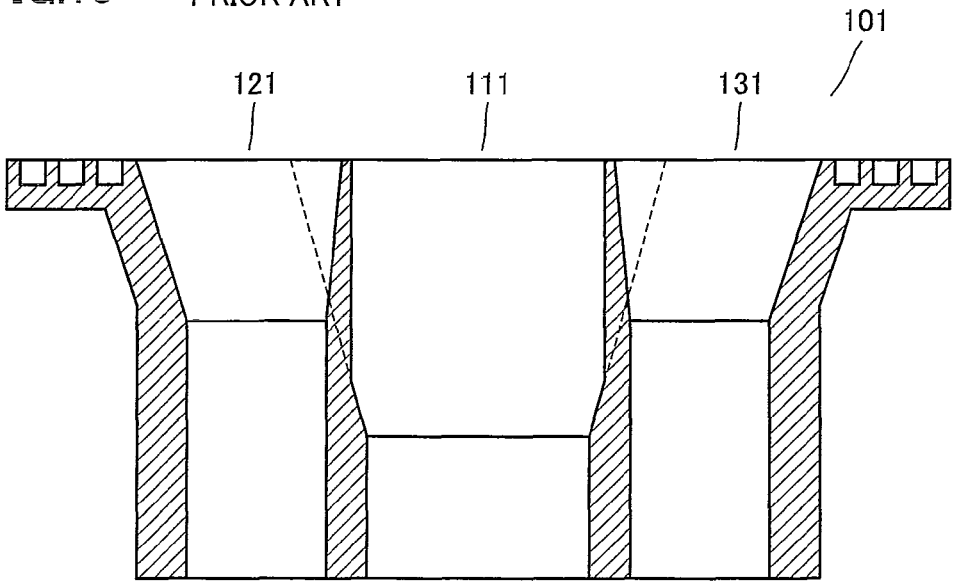
FIG.10 PRIOR ART
FIG. 10 is a cross sectional view of the multi-feed horn shown in FIG. 9.

Furthermore, as shown in FIG. 8, in an antenna apparatus 51 provided with this low noise block downconverter 41, low noise block downconverter 41 is supported at the predetermined position on the front side of a parabolic antenna 52 so as to receive the radio wave collected by parabolic antenna 52.

According to low noise block downconverter 41 and antenna apparatus 51 provided with the same, as previously described, the proximal end opening and the tip opening of the feed horn are rectangular in shape, which allows the frequency band which can be received to be widened. It is to be noted that, in the present multi-feed horn 1, the most suitable combination of the shapes of feed horns 11, 21 and 31 will be selected depending on the frequency band to be received and the manufacturing method. Therefore, the combination of the shapes of feed horns 11, 21 and 31 is not limited to the above-described combinations.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A multi-feed horn comprising:

a first feed horn having a first proximal end opening connected to a predetermined first waveguide and a first tip opening which is opened and located on a side opposite to said first proximal end opening;

a second feed horn having a second proximal end opening connected to a predetermined second waveguide disposed adjacent to said first waveguide and a second tip opening which is opened and located on a side opposite to said second proximal end opening; and a third feed horn having a third proximal end opening connected to a predetermined third waveguide disposed adjacent to said first waveguide on a side opposite to said second waveguide with respect to said first waveguide and a third tip opening which is opened and located on a side opposite to said third proximal end opening, at least said first tip opening of said first feed horn being rectangular in shape.

2. The multi-feed horn according to claim 1, wherein said first proximal end opening of said first feed horn is rectangular in shape, said second proximal end opening and said second tip opening of said second feed horn are rectangular in shape, and said third proximal end opening and said third tip opening of said third feed horn are rectangular in shape.

3. The multi-feed horn according to claim 1, wherein said first proximal end opening of said first feed horn is circular in shape, said second proximal end opening and said second tip opening of said second feed horn are rectangular in shape, and said third proximal end opening and said third tip opening of said third feed horn are rectangular in shape.

4. The multi-feed horn according to claim 1, wherein said first proximal end opening of said first feed horn is rectangular in shape, said second proximal end opening and said second tip opening of said second feed horn are circular in shape, and said third proximal end opening and said third tip opening of said third feed horn are circular in shape.

5. The multi-feed horn according to claim 1, wherein said first feed horn, said second feed horn and said third feed horn each are formed of a piece of sheet metal.

6. The multi-feed horn according to claim 1, wherein said first feed horn, said second feed horn and said third feed horn are integrally molded by aluminum die-casting.

7. A low noise block downconverter comprising the multi-feed horn according to claim 1.

8. An antenna apparatus comprising the low noise block downconverter according to claim 7.

* * * * *